United States Patent [19]

Sanders

[11] 4,255,487

[45] * Mar. 10, 1981

[54] ELECTRICALLY CONDUCTIVE TEXTILE FIBER

[75] Inventor: John H. Sanders, Newport News, Va.

[73] Assignee: Badische Corporation, Williamsburg, Va.

[ * ] Notice: The portion of the term of this patent subsequent to Jul. 9, 1991, has been disclaimed.

[21] Appl. No.: 795,472

[22] Filed: May 10, 1977

Related U.S. Application Data

[63] Continuation-in-part of Ser. No. 290,937, Sep. 21, 1972, abandoned, which is a continuation-in-part of Ser. No. 271,837, Jul. 14, 1972, Pat. No. 3,823,035.

[51] Int. Cl.[3] ..... C09C 1/44; D02G 3/00

[52] U.S. Cl. ..... 428/368; 427/122; 427/180; 427/393.1; 428/372; 428/395

[58] Field of Search ..... 427/390 B, 122, 222, 427/393.1, 180; 361/220; 428/368, 372, 395

[56] References Cited

U.S. PATENT DOCUMENTS

| | | | |
|---|---|---|---|
| 3,586,597 | 6/1971 | Okuhashi | 427/390 X |
| 3,823,035 | 7/1974 | Sanders | 427/122 X |

*Primary Examiner*—Michael R. Lusignan

*Attorney, Agent, or Firm*—George F. Helfrich

[57] ABSTRACT

Finely divided, electrically conductive particles are uniformly suffused into a filamentary polymer substrate in an annular region located at the periphery of the filamentary polymer substrate and extending along the length thereof. The electrically conductive particles are employed in an amount sufficient to render the electrical resistance of the filamentary polymer substrate not more than about $10^9$ ohms/cm. The filamentary polymer substrate finds special utility in the fabrication of antistatic fabrics and floor coverings.

5 Claims, No Drawings

ELECTRICALLY CONDUCTIVE TEXTILE FIBER

CROSS REFERENCE

This application is a continuation-in-part of my copending application Ser. No. 290,937, filed Sept. 21, 1972, now abandoned, which in turn is a continuation-in-part of application Ser. No. 271,837, filed July 14, 1972, which is now U.S. Pat. No. 3,823,035, patent July 9, 1974.

BACKGROUND OF THE INVENTION

1. Field of the Invention

This invention relates to textiles in general, and in particular to an electrically-conductive textile fiber for use in the fabrication of antistatic fabrics of various kinds.

2. Prior Art

The accumulation of static electricity as a result of the utilization of fabrics is a phenomenon which has commanded the attention of the textile industry for some time. The presence of static is a cause not only of annoyance (e.g. items of apparel cling to the body and are attracted to other garments; fine particles of lint and dust are attracted to upholstery fabrics, increasing the frequency of required cleaning; one experiences a jolt or shock upon touching a metal doorknob after walking across a carpet), but also of danger (e.g. the discharge of static electricity can result in sparks capable of igniting flammable mixtures such as ether/air, which are commonly found in hospitals, especially in operating rooms). All of these effects are accentuated in atmospheres of low relative humidity.

Of the many proposals for preventing the undesirable buildup of static electricity, the most satisfactory, with respect to their efficiency and permanence, appear to be those which comprehend the utilization of fibers possessing electrical conductivity (e.g. metal fibers, fibers coated with electrically conductive material, or metallic laminate filaments) in combination with common natural and man-made fibers to produce a woven, knitted, netted, tufted, or otherwise fabricated structure, which readily dissipates the static charges as they are generated. Some of the more noteworthy of these methods and structures and some pertinent references in considering the present application may be found in U.S. Pat. Nos. 2,129,594; 2,357,851; 2,714,569; 3,069,746; 3,288,175; 3,582,444; 3,582,445, 3,582,448, 3,586,597; 3,590,570; 3,706,195; 3,708,335; 3,729,449; 3,669,736; 3,726,955; 3,669,726; 3,129,053; 2,734,978; 2,566,441; and 2,473,183; in Webber, "Metal Fibers," *Modern Textiles Magazine,* May, 1966, pp. 72–75; in Belgian patents 775,935 and 790,254; in French Pat. No. 2,116,106; in British Pat. Nos. 354,233; 1,391,262; 1,417,394; in Japanese Utility Model Sho 42-21017; and Japanese patent 45-29920 filed May 25, 1967, issued Sept. 29, 1970.

Notwithstanding the efficacy of these and similar expedients, they are found lacking in certin important aspects, viz:

The manufacture of metallic fibers of fine denier, especially in the form of monofilaments, is a difficult and costly operation; and since such fibers are quite dissimilar in character from ordinary textile fibers, problems arise in connection with blending and processing, as well as in the hand of the products obtained.

Metallic laminate filaments, on the other hand, do not present blending and processing problems, because of their close similarity to ordinary textile fibers, and the hand of the products obtained is consequently not objectionable. However, the cost of such filaments is high when compared with the natural or man-made fibers with which they are blended.

Textile fiber substrates the surfaces of which have been coated by vapor deposition or electrodeposition, or by the application of adhesive compositions containing finely divided particles of electrically conductive material, are in some cases less costly than metal fibers and/or metallic laminate filaments, depending upon the nature of the electrically conductive material employed. However, such coatings are often found lacking in cohesion and adhesion and are frequently too thick to be practicable in some applications—especially when the nature of the electrically conductive particulate matter is such that a high concentration thereof is required for satisfactory conductivity. Economy is achieved, therefore, only through sacrifices in durability of conductivity of the fiber.

The extrusion of powered synthetic polymer/finely divided electrically conductive material blends into filaments or as extruded coatings on a filamentary substrate having the same or a different polymeric composition is also well known. Unfortunately, blends requiring a high concentration of the electrically conductive material are often not readily extruded, if at all, and any filaments and filamentary coatings which are produced therefrom are totally lacking in cohesion and adhesion.

References such as U.S. Pat. No. 2,357,851 and Belgian Pat. No. 790,254 comprehend either (a) total incorporation of particles in the fiber substrate (as would be obtained by the spinning of a solution or a melt containing them), or (b) surface incorporation of particles, achieved by the use of (1) an adhesive—e.g., to produce a true coating—or (2) impregnation of the particles into a fiber surface which has been softened or made tacky by means of a liquid softening agent and/or heat. The total incorporation of particles in the fiber substrate and the use of an adhesive to bind the particles to the fiber substrate as a true coating have been previously discussed as inadequate and undesirable, because of (1) loss of physical properties as a result of disruption of the structural integrity of the fiber and (2) a low degree of durability, respectively. Moreover, in the present invention, the surface of the fiber is dissolved, not softened. It is well known in the art that the dissolution mechanism is not the same as the mechanism of softening or swelling whether accomplished by heat or by means of softening (swelling) agents. When a polymeric material is softened or swollen by a liquid, the liquid is imbibed into the polymer to produce an expanded gel. It is only when a true solvent is used as the liquid that the expanded gel disintegrates to produce a true solution. That a true dissolution occurs in the present invention is clear from the examples of solvents employed: e.g., for nylon 6 (polycaprolactam)—concentrated formic acid and sulfuric acid. In the present invention, it is only because the solvent is removed before the structural integrity of the filament is destroyed (viz., almost immediately after application thereof) that the process has any utility. That such can be accomplished is considered unobvious. Furthermore, it is only because there is a true dissolution of the surface of the filament that the electrically conductive particles present as a dispersion in the solvent can suffuse uniformly into the surface of the filament, and later, after removal of the solvent, present a uniform dispersion rather than a mechanical penetration of electrically conductive particles, which results in no significant loss in physical properties while providing sufficient and durable conductivity for many applications.

In this regard, Japanese Pat. No. 45-29920 (1970), which discloses the incorporation of abrasive sands into the surface of plastic sheets by the application thereto of a dispersion of the sand in a solvent for the sheet, does not render the present invention obvious, since it is clear that the Japanese inventors had no concern that the structural integrity of their film would be destroyed (there is no recitation concerning the importance of removal of the solvent after application thereof). On the other hand, such removal of solvent is crucial in the process of the present application, as is clear from the instant specification and claims. That is to say, if a dispersion of conductive particles in a solvent for nylon 6 filaments were simply applied to such filaments, as might be suggested by the reference, and no provisions were made for almost instantaneous removal of the solvent, the filament would almost immediately disintegrate completely. To be sure, it is only because the solvent is removed before the structural integrity of the filament is destroyed (viz., almost immediately after application thereof) that the process of the present application has any utility. Moreover, in view of the background of the art, it is not at all obvious that such could, in fact, be accomplished. Indeed, other inventors dealing with fibers and filaments have chosen liquids which soften, rather than dissolve the surface of the fibers or filaments. In this regard, reference is again made to U.S. Pat. No. 2,357,851 and Belgian Pat. No. 790,254.

SUMMARY OF THE INVENTION

Accordingly, it is the primary object of this invention to provide a low-cost, yet durable, electrically conductive fiber which presents no problems in the blending and processing with ordinary natural and man-made textile fibers.

This object is achieved, and the disadvantages of the prior art are obviated, by providing an electrically conductive textile fiber which comprises a filamentary polymer substrate having finely divided, electrically conductive particles uniformly suffused through the filamentary polymer substrate in an annular region located at the periphery of the filament and extending along the length thereof. The electrically conductive particles are present in an amount sufficient to render the electrical resistance of the textile fiber not more than about $10^9$ ohms/cm. In contradistinction to a coating, the annular suffusion of the present invention is a spreading of electrically conductive particles through the fiber substrate itself. In contradistinction to a filament extruded from an intimate mixture of powdered polymer and finely divided, electrically conductive material, the suffusion of the present invention is confined to an annulus location at the periphery of the filament and extending along the length thereof. When the filamentary polymer substrate of the present invention is of substantially cylindrical configuration, it has been found especially advantageous if the annular region of suffused electrically conductive particles extends perpendicularly inwardly from the periphery of the filament up to a distance equal to about 1/10 the radius of the filament.

Throughout this specification and the appended claims, the word "suffuse" is to be understood to mean "to spread through a surface in the manner of a fluid", in accord with, and not repugnant to, the definitions of "suffuse" and "suffusion" given in the authoritative Webster's Third New International Dictionary and Webster's New Collegiate Dictionary respectively, as set forth below:

(From Webster's Third New International Dictionary) "to spread over or through in the manner of fluid or light."

(From Webster's New Collegiate Dictionary) "a spreading through a surface or extent, of something that gives color, texture, quality, etc." "Suffused" and "suffusion" are similarly understood. All teachings examples, and definitions of the invention are completely consistent with these meanings of "suffuse", "suffused", and "suffusion". Accordingly, the invention does not comprehend a coating of electrically conductive particles on the surface of a filament, but rather a penetration of such particles through the surface of the filament in the manner of a fluid, e.g., by means of the mechanism of dissolution of the surface of the filament followed by molecular movement of the particles therethrough.

The electrically conductive fiber of the present invention is economically produced, has very durable conductive properties, and substantially retains the characteristics of the filamentary polymer substrate, thereby affording a combination of properties unobtainable in the prior art. That sufficient conductivity could be achieved without substantial sacrifice in the characteristics of the filamentary polymer substrate and without substantial loss of cohesion of polymer in the suffused annular region, is indeed unexpected in view of the prior art.

DESCRIPTION OF THE PREFERRED EMBODIMENTS

The filamentary polymer substrate upon which the electrically conductive textile fiber of the present invention is based may be prepared from any of the well-known film or fiber forming polymers, such as cellulosics, acrylics, modacrylics, polystyrenes, polyolefins, polyesters, or polyamides, by standard techniques well-known in the art. A wide range of deniers (viz., from 1 to 100 and above) is advantageously employed. Monofilaments of polyamides such as nylon 6 having a denier of between about 5 and 50 have been found especially advantageous in most apparel and floor covering applications.

The finely divided, electrically conductive particles which are suffused in the filamentary polymer substrate are chosen in the light of their electrical conductivity, chemical resistance, weatherability, and resistance to washing, scouring and dyeing treatments, as well as economy. Particularly useful are the metallic powders such as silver and bronze, and the electrically conductive carbon blacks, all of which are readily available commercially. A wide range of particle sizes has been found acceptable. For electrically conductive carbon black a particle size of about 20 to 40 m$\mu$ is preferred. The concentration of electrically conductive particles—which is dependent upon the nature and particle size thereof, as well as the nature of the filamentary polymer substrate—is chosen so that the electrical resistance of the fiber will be not more than about $10^9$ ohms/cm, and most advantageously not less than about $10^4$ ohms/cm. (If the fiber has an electrical resistance of between about $10^4$ and $10^9$ ohms/cm, it is most advantageously employed in fabrics for preventing the accumulation of high charges of static electricity while presenting no appreciable electrocution hazard.) When electrically conductive carbon black having a particle size between about 20 and 40 mμ is suffused into a 15 denier monofilament of a polyamide such as nylon 6 for example, a carbon black concentration of between about 2 and 20 percent, based upon the total weight of the electrically conductive fiber, is preferred.

The suffusion of finely divided, electrically conductive particles in the filamentary polymer substrate is characterized by the existence of a discrete, independent phase of electrically conductive particles, uniformly dispersed in the polymer substrate in an annular region located at the periphery of the filament and extending inwardly along the length of the filament. When the filamentary polymer substrate is of substantially cylindrical configuration, which is very common in the art, it has been found of especial advantage if the annular region of suffused electrically conductive particles extends perpendicularly inwardly from the periphery of the filament up to a distance equal to about 1/10 the radius of the filament. Under such conditions the physical properties of the suffused filamentary substrate still closely approximate those of the unmodified, filamentary substrate while the conductivity thereof has been strikingly increased. For cross-sectional configurations other than circular (e.g., trilobal, square, rectangular, etc.) the annular region most advantageously extends up to a distance equal to about 1/10 the radius of a circle inscribed within the cross-sectional perimeter of the filament.

It is to be preferred that the annular suffusion of finely divided, electrically conductive particles extend along the entire length of the filament at its periphery. It is to be understood, however, that, either through inadvertence or design, small gaps may be produced in the suffusion along the length of the filament without serious impairment in the efficacy of the suffusion.

The electrically conductive textile fiber of the present invention may be prepared from commercially available filamentary polymer substrates using special techniques, the most satisfactory of which comprehend applying to the filamentary polymer substrate a dispersion of the finely divided, electrically conductive material in a liquid which is a good solvent for the substrate but does not react with or dissolve the electrically conductive material. A combination of such liquids may be used if desired. The chosen concentration of electrically conductive material in the solvent system is dependent upon the desired fiber conductivity and is limited by the viscosity of the dispersion. (Dispersions which are either too viscous or not viscous enough are difficulty applied when certain methods of application are expedient.)

Application of this dispersion to the filamentary substrate may be by padding, painting, spraying, dipping, rolling, printing, or the like. If desired for viscosity or other purposes, the dispersion may contain dissolved polymer of the same nature as that of the substrate, under which conditions the annular suffusion terminates imperceptibly in an integral coating of the same composition. In any event, solvent removal from the substrate must be effected before the structural integrity thereof is appreciably destroyed. This is conveniently accomplished by vaporization (for volatile solvents) and/or washing with a non-solvent (for non-volatile solvents) after the desired degree of solvent penetration has taken place (especially up to about 1/10 of the radius of substantially cylindrical filamentary substrates). By way of example, when filamentary substrates of polyamides such as nylon 6 are employed, the applicable dispersion may be 5 to 15% carbon black in concentrated formic acid, or it may be 5 to 15% carbon black in concentrated sulfuric acid. In the former case the formic acid solvent may be advantageously removed by continuously passing the dispersion-treated filament through a chamber in which the air is continually exchanged, e.g., by means of air jets and/or means for evacuation. In the latter case the sulfuric acid solvent may be advantageously removed by continuously passing the dispersion-treated filament through a water bath. After removal of solvent has been accomplished, the filament is dried by conventional means and packaged for subsequent use.

The electrically conductive textile fiber of the instant invention finds special utility in the production of fabrics the use of which avoids the accumulation of high charges of static electricity while presenting no appreciable electrocution hazard. By way of illustration, woven fabrics are produced by standard interweaving of the electrically conductive fiber of the instant invention with ordinary threads made from natural fibers such as cotton or wool, and/or man-made fibers such as nylon, rayon, acrylic, or polyester. The electrically conductive fiber is present in an amount equal to about 0.05–100, and preferably 0.1–5 percent by weight of the woven fabric. By way of further illustrating the special utility of the electrically conductive fiber of the present invention, pile fabrics are produced comprising a backing material having pile loops anchored therein. The backing material comprises chain yarns interwoven with filler yarns, as is very well-known in the art. Moreover, the backing material may be constructed from any of the materials commonly employed in the art, such as jute or hemp, among many others. The pile loops comprise a yarn made of a plurality of strands twisted together by standard techniques. At least one such strand comprises the electrically conductive fiber of the present invention. The balance of the yarn comprises any commonly employed natural or man-made fibers. As will be understood by one of skill in the art, it may not be necessary that every end of yarn in the pile contain a strand of the electrically conductive fiber of the present invention. Moreover, more than one strand of the electrically conductive fibers per end of yarn in the pile may be advantageous, especially under conditions of very low relative humidity. In any event, the electrically conductive fiber of the present invention is present in an amount equal to about 0.05–100, and preferably 0.1–5 percent by weight of the pile fabric.

Fabrics such as those the preparation of which is outlined above, when employed in an atmosphere having a relative humidity of 20%, will not generate a static charge above about 3000 volts, which is in proximity to the threshold level of human sensitivity. These fabrics, moreover, when containing an especially preferred embodiment of the electrically conductive fiber of the present invention, do not present an electrocution hazard to those contacting them in the event of an accidental and simultaneous contact of such fabrics with a source of essentially unlimited electrical current, as is available from an ordinary electrical outlet, or an electrical applicance short-circuited by insulation failure.

The present invention may be better understood by a reference to the following illustrative examples, wherein all parts and percentages are by weight unless otherwise indicated.

EXAMPLE 1

This example specifies detail concerning a method of making an electrically conductive fiber according to the present invention, and sets forth some of the basic properties thereof.

A cold-stretched 15 denier nylon 6 monofilament having a circular cross-sectional diameter of 42μ was continuously directed at a rate of 400 meters/minute from a source of supply through the interface of two opposing surfaces of a polyester pad which was kept saturated with the following dispersion:

| | |
|---|---|
| Carbon black (30 mμ): | 10% |
| Formic acid (80%, aqueous): | 90% |

Thereupon the filament was conducted into and through a 20 footlong, elongated chamber in which the air at room temperture was continuously exchanged by means of air jets and exhaust openings. Removal of the volatile formic acid solvent was thereby accomplished, and the filament was substantially dry. After exiting the elongated chamber, the filament was continuously wound into a package at a rate of 400 meters/minute.

Microscopic examination of transverse sections of the resulting filament revealed a uniform dispersion of particles of carbon black in an annular region along the length of the filament and extending perpendicularly inwardly from the periphery of the filament up to a distance equal to about 1/10 the radius of the filament. The carbon black content of the filament was determined to be 10 percent. The total cross-sectional diameter of the filament, however, was not appreciably changed, measuring less than 43μ. A suffusion, rather than an ordinary coating, had therefore resulted from the specified treatment.

Conductivity measurements on the treated filament were taken using a Keithley 610 C Electrometer. Tensile properties were measured using standard methods and apparatus well-known in the art. The results of these tests are summarized in Table I below, wherein a comparison is made with the untreated 15 denier nylon 6 filament.

TABLE I

| Sample | Cross-Sectional Diameter, μ | Resistance ohms/cm | Ultimate Tensile, g | Elongation to Break % |
|---|---|---|---|---|
| A. 15 denier nylon 6 filament treated according to example 1 (THIS INVENTION) | <43 | $1 \times 10^6$ | 81 | 45 |
| B. 15 denier nylon 6 filament untreated (FOR COMPARISON) | 42 | $1 \times 10^{14}$ | 83 | 30 |

The comparison in Table I shows that whereas the conductivity of the filament according to the present invention is significantly enhanced, the tensile properties thereof are not substantially diminished; i.e. the desirable characteristics of the filamentary polymer substrate are retained while significant conductivity is achieved.

EXAMPLE 2

This example specifies detail concerning a modified method of making an electrically conductive fiber according to the present invention.

A cold-stretched 15 denier nylon 6 monofilament having a circular cross-sectional diameter of 42μ was treated in exactly the same manner as specified in Example 1 above, except that the dispersion had the following contents:

| | |
|---|---|
| Carbon black (30 mμ): | 5% |
| Powdered nylon 6 substrate: | 5% |
| Formic acid (80%, aqueous): | 90% |

The powdered nylon 6 substrate was dissolved in the dispersion in order to enhance the viscosity thereof, so that even application to the filamentary substrate might be facilitated. Moreover, the slip and flow characteristics of the dispersion were also enhanced.

Microscopic examination of transverse sections of the filament resulting from this procedure revealed the same annular suffusion as that of the filament treated according to Example 1. The total cross-sectional diameter of the filament remained substantially the same as that of the untreated filament, and the annular suffusion extended perpendicularly inwardly from the periphery of the filament up to a distance equal to about 1/10 the radius of the filament. Conductivity and tensile properties were substantially the same as those of the treated filament of Example 1. The carbon black content of the filament was determined to be approximately 10 percent.

EXAMPLE 3

This example specifies detail concerning yet another method of making an electrically conductive fiber according to the present invention.

A cold-stretched 15 denier nylon 6 monofilament identical with those employed as the filamentary substrates in Examples 1 and 2 was continuously directed at a rate of 400 meters/minute from a source of supply through the interface of two opposing surfaces of a polyester pad which was kept saturated with the following dispersion:

| | |
|---|---|
| Carbon black (30 mμ): | 9% |
| Powdered nylon 6 polymer substrate: | 14% |
| Sulfuric acid (50%, aqueous); | 77% |

The filament was then immediately conducted below the surface of cold water in a bath to remove sulfuric acid. After exiting the bath, the filament was dried by jets of warm air and was finally continuously wound into a package at a rate of 400 meters/minute. Examination of this filament revealed substantially the same suffusion as that of the treated filaments of Examples 1 and 2. Moreover, the conductivity and tensile properties of the treated filament of Example 3 were not appreciably different from those of the treated filaments of Examples 1 and 2. The carbon black content of the filament was determined to be approximately 10 percent.

EXAMPLE 4

This example illustrates the integral nature of an electrically conductive fiber according to the present invention, and shows the surprising cohesion of polymer in the annular region of suffused electrically conductive particles.

Unstretched 15 denier nylon 6 monofilament of circular cross-section was treated exactly according to the method of Example 2. Microscopic examination of a transverse section of the treated filament revealed a suffusion of particles of carbon black in an annular region extending along the length of the filament and perpendicularly inwardly up to a distance equal to about 1/10 the radius of the filament. The resistance of the filament was measured at $3\times10^5$ ohms/cm.

This filament was then cold stretched to 3 times its original length. The resistance of the stretched filament was measured at $5\times10^6$ ohms/cm, and close scrutiny of the surface of the stretched filament showed no desquamation or other deterioration of the annular suffusion of electrically conductive particles—substantial loss of conductivity, excessive flaking, and overall deterioration being generally observed when coated filaments are subjected to such stretching operations.

EXAMPLE 5

This example further illustrates the outstanding durability of electrically conductive fibers according to the present invention. The treated filament of Example 2 was employed in the preparation of a conventional double knit fabric using standard techniques well-known in the art, one end of the treated filament of Example 2 being twisted in or plied in every ten ends fed to the knitting machine. The balance of the fabric consisted of 1 end/150 denier polyester filament and 2 ends 28's acrylic staple yarn. The fabric was subjected to 135 launderings [utilizing a standard laundry detergent, hot wash (120° F.) and cold rinse (wash and wear cycle)] and tumble dryings (20 minutes at an average temperature of 145° F.), after which the average resistance of the individual electrically conductive fibers was measured. Resistance before launderings and tumble dryings: $5\times10^6$ ohms/cm. Resistance after 135 launderings and tumble dryings: $5\times10^6$ ohms/cm.

EXAMPLE 6

This example is illustrative of the utility of an electrically conductive fiber according to the present invention. Moreover, by comparison with the use of an electrically conductive fiber of the prior art, the outstanding and unobvious advantages of fibers according to the present invention are further delineated.

Experiment A (This Invention)

A single strand of the electrically conductive fiber of Example 2 above was twisted with a bulked, continuous filament nylon 6 carpet yarn comprising 136 individual strands and having a total denier of 2600, to produce antistatic yarn A. Employing a jute backing material and utilizing a standard tufting machine, an 18 oz/yd$^2$ level loop carpet A having a pile height of ¼" was prepared from antistatic yarn A and a 2600/136 bulked, continuous filament nylon 6 carpet yarn; antistatic yarn A being incorporated in every fourth end of the pile. The electrically conductive fiber of Example 2 was present in an amount equal to 0.2 percent by weight of the pile of carpet A.

Experiment B (For Comparison)

An electrically conductive fiber B, exemplary of the prior art, was prepared by coating a cold stretched 15 denier monofilament of nylon 6 with a composition consisting of 25 percent of a crosslinked vinyl polymer adhesive, 20 percent of electrically conductive carbon black (30 mμ) dispersed therein, and 55 percent of a methyl isobutyl ketone solvent. After the coated filament was passed through a slit to adjust coating thickness, it was then completely cured by heating with an infrared lamp. The average coating thickness of this filament was 12μ, and the average electrical resistance thereof was $1\times10^6$ ohms/cm. A single strand of this filament was then twisted with a bulked, continuous filament nylon 6 carpet yarn comprising 136 individual strands and having a total denier of 2600, to produce antistatic yarn B. Employing a jute backing material and utilizing a standard tufting machine, an 18 oz./yd$^2$ level loop carpet B having a pile height of ¼" was prepared from antistatic yarn B and a 2600/136 bulked, continuous filament 6 nylon carpet yarn; antistatic yarn B being incorporated in every fourth end of the pile. The electrically conductive fiber B was present in an amount equal to 0.2 percent by weight of the pile of carpet B.

Experiment C

Carpets A and B were then individually subjected to the Static Electricity Test set forth below. The results of such testing are reported in Table II below as "Initial Static Electricity".

Following the initial static electricity testing, Carpets A and B were each subjected to an identical accelerated wearing procedure for 60 hours, after which static electricity testing was again effected. The results of such testing are reported in Table II below as "Final Static Electricity."

From Table II it can be seen that although carpets A and B were each initially static protected (viz., they did not allow the generation of a static charge in excess of 3000 volts, which is generally accepted as the average thresh hold level of human sensitivity), only carpet A was static protected after extensive wear. Moreover, microscopic examination of the electrically conductive fibers A and B revealed that whereas fiber A showd no deterioration, the coating of fiber B was excessively abraded and incoherent after excessive wear.

Static Electricity Test

The fabric to be tested is first cut into sample squares 36 inches on a side. These samples are conditioned for 7 days by being hung from racks in a test room equipped with a rubber floor mat and having an area of at least 100 square feet, wherein the temperature is controlled at 70°±2° F. and the relative humidity is controlled at 20%±1%. Free circulation of air over all sample surfaces is effected, but the samples are not allowed to contact each other. A pair of Neolite or PVC-sole test shoes is also conditioned for the same period, under the same conditions.

Residual static charge on the rubber floor mat is then neutralized by passing twice over its entire surface a polonium wand, which consists of 6 polonium 210 alloy strips mounted end-to-end on a head attached to a handle. A fabric sample is then placed upon the rubber floor mat, and its residual static charge is neutralized in the same manner. The soles of the test shoes are then cleaned by sanding their entire surface with fine sandpaper, followed by a wiping with cheesecloth to remove dust particles.

Wearing the test shoes and holding a hand probe which is connected to an electrostatic detection head, a human operator steps upon the carpet sample and grounds the probe. Then while holding the hand probe, the operator walks normally on the sample at a rate of 2 steps a second for a 30-second period, being careful not to scuff or rub the shoes over the fabric. If at the end of the 30-second period the voltage has not reached a steady maximum, the walk is continued for an additional 30 seconds. The maximum voltage recorded during the walk is the static level of the sample, the average for two operators being recorded in Table II as static electricity in volts.

TABLE II

| | Initial Static Electricity, volts | | Final Static Electricity, volts | |
|---|---|---|---|---|
| Carpet Sample | Neolite soles | PVC soles | Neolite soles | PVC soles |
| A (THIS INVENTION) | 1800 | 2000 | 2000 | 2700 |
| B (FOR COMPARISON) | 1900 | 2100 | 4600 | 6200 |

EXAMPLE 7

This example illustrates additional filamentary polymer substrates which find utility in the practice of the present invention.

In a series of individual experiments, the procedures and results of which are summarized in Table III below, various filamentary polymer substrates were separately directed through the interface of two opposing surfaces of a polyester pad which was kept saturated with the indicated dispersion of electrically conductive particles in volatile solvent. After volatile solvent had been removed from each treated filamentary polymer substrate, the electrical conductivity thereof was measured and recorded. Recorded also in Table III is the electrical conductivity of each filamentary polymer substrate in its untreated form.

In each experiment the result was a durable, uniform, annular suffusion of finely divided, electrically conductive particles in the filamentary polymer substrate.

TABLE III

| Experiment | Filamentary Polymer Substrate | Untreated Substrate Denier | Untreated Substrate Resistance, ohms/cm | Treating Dispersion | Resistance of Treated Substrate, ohm/cm |
|---|---|---|---|---|---|
| A | Modacrylic (Approx. 60% acrylonitrile, Approx. 25% vinylidene chloride, and Approx. 14% Butyl Acrylamid) | 15 | $10^{10}$ | Carbon black (30 mμ): 10%<br>Acetone : 90% | $2 \times 10^6$ |
| B | Cellulose tri-acetate | 200/34 | $10^{10}$ | Carbon black (30 mμ): 10%<br>Acetone : 90% | $2 \times 10^5$ |
| C | Polystyrene | 80 | $10^{10}$ | Carbon black (30 mμ): 10%<br>Benzene : 90% | $5 \times 10^6$ |

The unique combination of properties possessed by electrically conductive fibers according to the present invention renders them especially suitable for use not only in carpets, rugs, and other floor coverings, but also in bed coverings, especially in hospitals; in curtains, especially in hospitals for separation of cubicles; in articles of apparel, especially undergarments such as slips; in hosiery, especially in panty hose and half hose; and is sewing threads.

Although the present invention has been described in detail with respect to certain preferred embodiments thereof, it is apparent to those of skill in the art that variations and modifications in this detail may be effected without any departure from the spirit and scope of the present invention, as defined in the hereto-appended claims.

What is claimed is:

1. An electrically conductive textile fiber comprising a nylon 6 filamentary polymer substrate having finely divided, electrically conductive particles of carbon black suffused through the surface of the filamentary polymer substrate, the electrically conductive particles being present inside the filamentary polymer substrate as a uniformly dispersed phase independent of the phase of the filamentary polymer substrate in an annular region located at the periphery of the filamentary polymer substrate and extending inwardly along the length thereof, the electrically conductive particles being present inside the filamentary polymer substrate in an amount sufficient to render the electrical resistance of the electrically conductive textile fiber not more than about $10^9$ ohms/cm.

2. The method of preparing an electrically conductive textile fiber from a non-conductive, filamentary polymer substrate, which method comprises suffusing finely divided, electrically conductive particles through the surface of the filamentary polymer substrate into an annular region located at the periphery of the filamentary polymer substrate and extending inwardly along the length thereof, so that the electrically conductive particles are present inside the filamentary polymer substrate as a uniformly dispersed phase independent of the phase of the filamentary polymer substrate in an amount sufficient to render the electrical resistance of the electrically conductive textile fiber not more than about $10^9$ ohms/cm.

3. The method of claim 2, wherein the filamentary polymer substrate is nylon 6, and the finely-divided, electrically conductive particles are particles of carbon black.

4. The method of claim 2, wherein the filamentary polymer substrate is of substantially cylindrical configuration, and the annular region of uniformly dispersed electrically conductive particles extends perpendicularly inwardly from the periphery of the filamentary polymer substrate up to a distance equal to about 1/10 the radius of the filamentary polymer substrate.

5. The method of claim 2, wherein the suffusing of the finely divided electrically conductive particles through the surface of the filamentary polymer substrate is accomplished by:

(a) applying to the filamentary polymer substrate a dispersion of finely-divided electrically conductive particles in an amount sufficient to render the electrical resistance of the filamentary polymer substrate not more than about $10^9$ ohms/cm in liquid which is a solvent for the filamentary polymer substrate but does not dissolve or react with the electrically conductive particles; and (b) removing the solvent from said filamentary polymer substrate after the desired degree of penetration therein has taken place in an annular region located at the periphery of the filamentary polymer substrate, and before the structural integrity of the filamentary polymer substrate has been destroyed.

* * * * *